US011867429B2

(12) United States Patent
Humphrey et al.

(10) Patent No.: US 11,867,429 B2
(45) Date of Patent: Jan. 9, 2024

(54) TANKLESS WATER HEATER WITH INTEGRATED VARIABLE SPEED PUMP

(71) Applicant: RINNAI AMERICA CORPORATION, Peachtree City, GA (US)

(72) Inventors: Scott Gilman Humphrey, Newnan, GA (US); Michael Scott Knoblett, Newnan, GA (US)

(73) Assignee: Rinnai America Corporation, Peachtree City, GA (US)

( * ) Notice: Subject to any disclaimer, the term of this patent is extended or adjusted under 35 U.S.C. 154(b) by 160 days.

(21) Appl. No.: 17/003,093

(22) Filed: Aug. 26, 2020

(65) Prior Publication Data

US 2021/0063024 A1 Mar. 4, 2021

Related U.S. Application Data

(60) Provisional application No. 62/891,594, filed on Aug. 26, 2019.

(51) Int. Cl.
*F24H 15/175* (2022.01)
*F24D 19/10* (2006.01)
(Continued)

(52) U.S. Cl.
CPC ..... *F24H 15/175* (2022.01); *F24D 17/0031* (2013.01); *F24D 19/1051* (2013.01);
(Continued)

(58) Field of Classification Search
CPC ..... F24H 9/133; F24H 9/139; F24H 9/2007; F24H 9/2021; F24H 9/2028; F24H 1/08;
(Continued)

(56) References Cited

U.S. PATENT DOCUMENTS 4,473,351 A * 9/1984 Hill ..... F23B 5/04 432/2
4,492,091 A * 1/1985 Whitwell ..... F24D 19/1054 122/15.1

(Continued)

FOREIGN PATENT DOCUMENTS

DE 202015001807 U1 * 7/2016 ..... F24D 17/0031
KR 20040106652 A * 12/2004

OTHER PUBLICATIONS

Temperature Controller Basics Handbook, Sep. 13, 2012, INSTRUMART, pp. 5-6 https://www.instrumart.com/pages/283/temperature-controller-basics-handbook (Year: 2012).*

(Continued)

*Primary Examiner* — Edelmira Bosques
*Assistant Examiner* — Michael James Giordano
(74) *Attorney, Agent, or Firm* — Quinn IP Law

(57) ABSTRACT

Various implementations include a water heater system. The system includes a variable speed pump. The variable speed pump has having an inlet and an outlet. The system includes a heat exchanger, having an inlet and an outlet. The heat exchanger outlet is fluidically connected to the variable speed pump inlet. The system includes an output temperature sensor disposed downstream of the heat exchanger outlet. The system includes a controller configured to receive a first temperature reading from the output temperature sensor. The controller is configured to control operation of the variable speed pump to adjust an output flow rate in response to the first temperature reading. The controller is further configured to receive a second temperature reading from a recovery temperature sensor on a storage tank. The controller is configured to turn off the variable speed pump upon a determination that the second temperature reading has reached a maximum temperature.

17 Claims, 3 Drawing Sheets

(51) Int. Cl.

| | |
|---|---|
| ***F24H 1/10*** | (2022.01) |
| ***F24H 9/02*** | (2006.01) |
| ***F24D 17/00*** | (2022.01) |
| ***F24H 15/219*** | (2022.01) |
| ***F24H 15/223*** | (2022.01) |
| ***F24H 15/34*** | (2022.01) |
| ***F24H 15/215*** | (2022.01) |
| ***F24H 15/36*** | (2022.01) |
| ***F24H 15/281*** | (2022.01) |

(52) U.S. Cl.
CPC ..... *F24H 1/10* (2013.01); *F24H 9/02* (2013.01); *F24H 15/215* (2022.01); *F24H 15/219* (2022.01); *F24H 15/223* (2022.01); *F24H 15/34* (2022.01); *F24D 2220/0207* (2013.01); *F24D 2220/042* (2013.01); *F24H 15/281* (2022.01); *F24H 15/36* (2022.01)

(58) Field of Classification Search
CPC ..... F24H 1/122; F24H 1/125; F24D 17/0031; F24D 17/0078; F24D 17/1012; F24D 17/1015; F24D 17/1051; F24D 2220/0207; F24D 2220/025; F24D 2220/042; Y02B 30/70
See application file for complete search history.

(56) References Cited

U.S. PATENT DOCUMENTS 5,006,689 A * 4/1991 Kurachi ..... F24H 1/185 122/494
5,020,721 A * 6/1991 Horne ..... F24D 17/00 122/18.4
5,056,712 A * 10/1991 Enck ..... G05D 23/1904 236/47
8,191,513 B2 * 6/2012 Krause ..... G05D 23/1917 122/20 R
8,322,313 B2 * 12/2012 Yamaoka ..... F24H 1/186 122/406.1
8,971,694 B2 * 3/2015 Deivasigamani ... F24D 17/0078 392/307
9,303,896 B2 * 4/2016 Lesage ..... F24H 1/202
9,335,066 B2 5/2016 Humphrey et al.
9,909,780 B2 3/2018 Humphrey et al.
2007/0257123 A1 * 11/2007 Kobayashi ..... F24H 9/2035 237/19
2008/0216770 A1 * 9/2008 Humphrey ..... F24H 1/145 122/13.3
2011/0305444 A1 * 12/2011 Pussell ..... F24D 17/0031 392/471
2016/0003468 A1 * 1/2016 Malone ..... F24D 1/005 122/15.1
2017/0130989 A1 * 5/2017 Forseth ..... F24H 1/125
2018/0347830 A1 * 12/2018 Callahan ..... F24D 19/1051

OTHER PUBLICATIONS

Cyclone Mxi Modulating High Efficiency, 2014, AO Smith https://www.hotwater.com/resources/literature/brochures/cyclone-mxi-modulating-sell-sheet-(aoscg71005)/ (Year: 2014).*
Driver PID Settings, Apr. 16, 2016, THORLABS https://www.thorlabs.com/newgrouppage9.cfm?objectgroup_id=9013#:~:text=To%20tune%20your%20PID%20controller,to%20roughly%20half%20this%20value. (Year: 2016).*

* cited by examiner

TANKLESS WATER HEATER WITH INTEGRATED VARIABLE SPEED PUMP

CROSS REFERENCE TO RELATED APPLICATIONS

This application claims priority to U.S. Provisional Patent Application Ser. No. 62/891,594 filed Aug. 26, 2019, the disclosure of which is expressly incorporated herein by reference.

BACKGROUND

The need for heated fluids, and in particular heated water, has long been recognized. Conventionally, water has been heated by heating elements, either electrically or with gas burners, while stored in a tank or reservoir. While effective, energy efficiency and water conservation using a storage tank alone can be poor. As an example, water that is stored in a hot water storage tank is maintained at a desired temperature at all times. Thus, unless the storage tank is well insulated, heat loss through radiation can occur, requiring additional input of energy to maintain the desired temperature. In effect, continual heating of the stored water in the storage tank is required.

Many of the problems with traditional hot water storage tanks have been overcome by the use of tankless water heaters. With the tankless water heater, incoming ground water passes through a component generally known as a heat exchanger and is instantaneously heated by heating elements (or gas burner) within the heat exchanger until the temperature of the water leaving the heat exchanger matches a desired temperature set by a user of the system. With such systems the heat exchanger is typically heated by a large current flow (or Gas/BTU input) which is regulated by an electronic control system. The electronic control system also typically includes a temperature selection device, such as a thermostat, by which the user of the system can select the desired temperature of the water being output from the heat exchanger.

Tankless water heaters are often run in cycles to maintain a desired water set point temperature. Some tankless water heater operation cycles include recovery cycles, which are run to increase water heating efficiency. Tankless water heaters often utilize an external fluid pump to recirculate heated water into the tankless water heater for the recovery cycle. Fixed flow rate recovery pumps are typically employed to recirculate water. A controller typically activates the recovery pump to pump previously heated water from a storage tank, or other water source, back into the tankless water heater. Tankless water heaters may include a water flow control valve to regulate the flow of water to match the output water temperature to a set point temperature.

SUMMARY

Various implementations include a water heater system. The system includes a variable speed pump. The variable speed pump has an inlet and an outlet. The variable speed pump has a heat exchanger, having an inlet and an outlet. The heat exchanger outlet is fluidically connected to the variable speed pump inlet. The system includes an output temperature sensor disposed downstream of the heat exchanger outlet. The system includes a controller configured to receive a first temperature reading from the output temperature sensor. The controller is configured to control operation of the variable speed pump to adjust an output flow rate in response to the first temperature reading.

In some implementations, the controller is configured to maintain the first temperature reading within a threshold of a set point temperature.

In some implementations, the controller is further configured to receive a second temperature reading from a recovery temperature sensor, wherein the controller is configured to turn off the variable speed pump upon a determination that the second temperature reading has reached a maximum temperature.

In some implementations, the set point temperature is greater than 120° F. and the threshold is greater than 3° F.

In some implementations, the system includes a fixed bypass having a first end that is fluidically connected to the heat exchanger inlet and a second end that is fluidically connected to the heat exchanger outlet and the variable speed pump inlet.

In some implementations the system includes a heater housing, wherein the variable speed pump, heat exchanger, output temperature sensor, and the controller are disposed inside the heater housing.

In some implementations, a heater in the heat exchanger operates at least at 39,800 BTU/h.

Various other implementations include a hot water storage system. The hot water storage system includes a tankless water heater system. The water heater system includes a variable speed pump. The variable speed pump has an inlet and an outlet.

The water heater system has a heat exchanger. The heat exchanger has an inlet and an outlet. The heat exchanger outlet is fluidically connected to the variable speed pump inlet. The water heater system has an output temperature sensor disposed downstream of the heat exchanger outlet.

The hot water storage system has a controller configured to control operation of the variable speed pump. The hot water storage system includes a storage tank which is a fluidically connected to the heat exchanger outlet. The hot water storage system also includes an outlet fluidically connected to the heat exchanger inlet. The hot water storage system also includes a tank temperature sensor, disposed at a location adjacent to the tank outlet.

The controller is configured to adjust an output flow rate of the variable speed pump in response to the first temperature reading and is configured to turn off the variable speed pump based on the second temperature reading.

In some implementations, the storage tank inlet is disposed on an upper portion of the storage tank, and the storage tank outlet is disposed on a lower portion of the storage tank.

In some implementations, the controller is configured to maintain the first temperature reading within a threshold of a set point temperature In some implementations, the threshold is plus or minus ten degrees of the set point temperature.

In some implementations the set point temperature is greater than 120 degrees.

In some implementations, the controller is configured to decrease the flow rate in response to a determination that the first temperature reading is more than the threshold less than the set point temperature.

In some implementations, the tankless water heater system includes a fixed bypass having a first end that is fluidically connected to the heat exchanger inlet and a second end that is fluidically connected to the heat exchanger outlet and the variable speed pump inlet.

In some implementations, the tankless water heater system further comprises a heater housing, wherein the variable speed pump, heat exchanger, output temperature sensor, and the controller are disposed inside the heater housing.

Various other implementations include a method of heating water comprising. The method includes receiving a signal to initiate circulation. The method also includes, generating a signal to a variable speed pump to circulate a flow of water at a first flow rate from an outlet of a heat exchanger to an inlet of a storage tank and from an outlet of the storage tank to an inlet of the heat exchanger. The method also includes receiving a first temperature reading from an output temperature sensor downstream of the heat exchanger. The method also includes generating a signal to the variable speed pump to circulate the flow of water at least at one additional flow rate.

In some implementations, the method includes generating a signal to the variable speed pump to adjust the output flow rate to maintain the first temperature reading within a threshold of a set point temperature.

In some implementations, the threshold is plus or minus ten degrees of the set point temperature.

In some implementations, the set point temperature is greater than 120 degrees.

In some implementations, the method includes sending a signal to operate a heater in the heat exchanger at least at 39,800 BTU/h.

DETAILED DESCRIPTION

Figure 1:
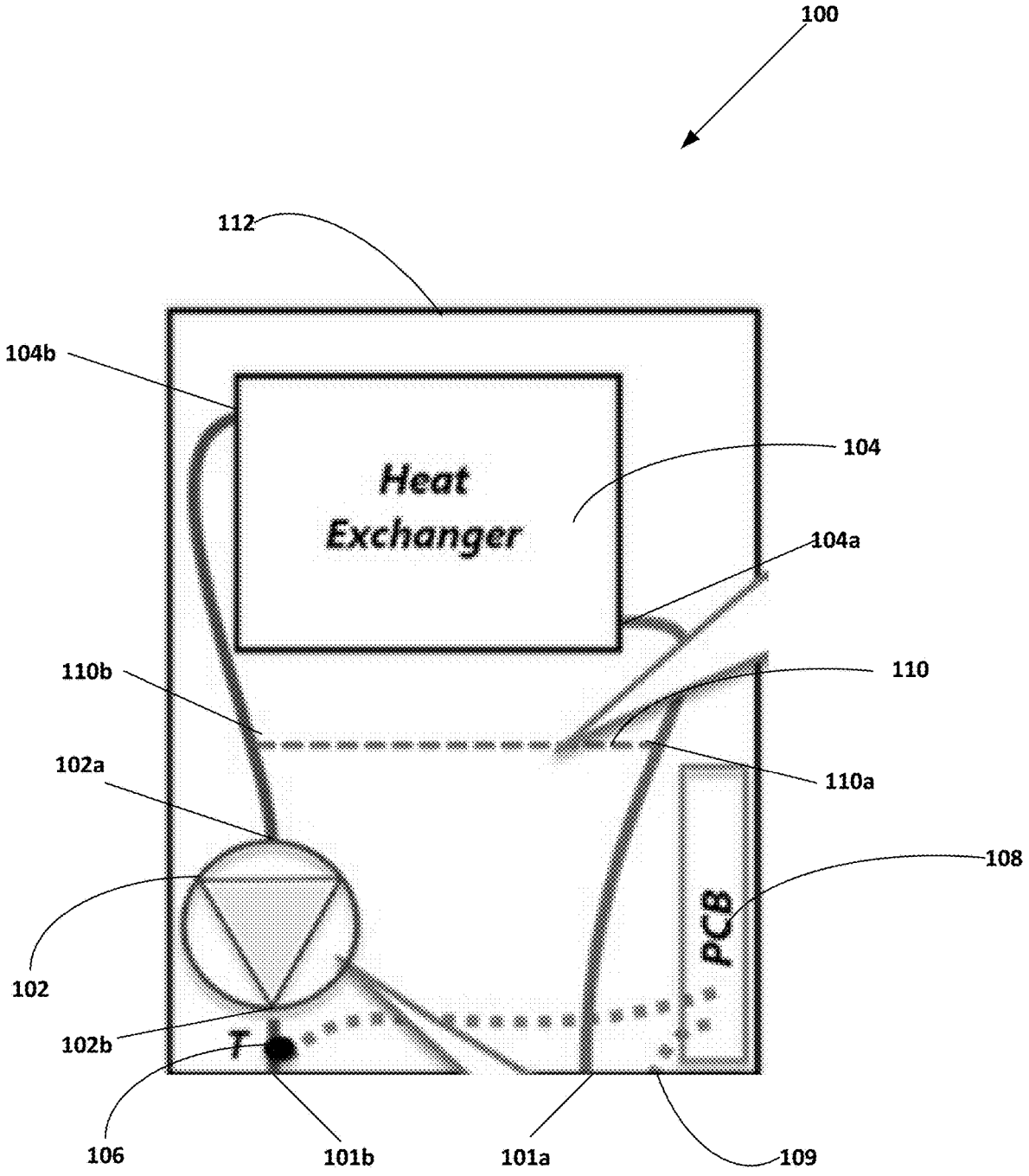
FIG. 1 shows a component view of a water heater system.

It should be understood at the outset that although illustrative implementations of one or more embodiments are illustrated below, the disclosed systems and methods may be implemented using any number of techniques, whether currently known or in existence. Like numbers represent like parts throughout the various figures, the description of which is not repeated for each figure. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

Traditional tankless water heaters directly supply water to a plumbing network. As such, traditional tankless water heaters need narrow output temperature tolerances (e.g. 1-3° F.). Such traditional tankless water heaters use complex temperature management solutions to ensure that hot water reaches desired plumbing fixtures. Traditionally tankless water heaters operate at a turn down ration of 13:1 (15,000-199,000 BTU/h) so as to supply hot water over a wide operating temperature range (e.g. 98-183° F.). However, traditional tankless water heaters have a lower efficiency at lower temperatures in the temperature ranges (i.e. less than 120° F.).

When used with a storage tank in a hybrid water heater system, a tankless water heater does not supply water directly to a plumbing network, but supplies hot water to the storage tank which in turn connects to the plumbing network in a building or premises. As such, the output temperature tolerance for the tankless water heater can be increased because the heated water will be pumped into the storage tank and mixed with water therein, mitigating the potential for temperature spikes in the hot water within the plumbing network. For example, the output temperature tolerance of the tankless water heater may be increased to 5-10° F. Additionally, the range of operating temperatures for the tankless water heater may be increased (e.g., 120-183° F.).

Because the range of operating temperatures and the output temperature tolerance for the tankless water heater is increased, the turndown ratio of the tankless water heater may be decreased. For example, the turndown ratio may be reduced to 5:1 (39,800-199,000 BTU/h). Therefore, the efficiency of the tankless water heater may be increased and optimized for use in a hybrid water heater system.

A water heater system that includes a variable speed pump can modulate the rate at which hot water is pumped between a storage tank and the tankless water heater system. With the ability to dynamically change an output flow rate of the variable speed pump, the water heater system can utilize a BTU/h of at least 39,800 instead of a lower BTU/h, resulting in a more efficient operation. Additionally, the use of the variable speed pump for controlling the output temperature of the water heater provides for a simplified and less costly design.

Accordingly, a tankless water heater system is disclosed herein that is more efficient and less costly for use in a hybrid water heater system. The tankless water heater operates at a lower turndown ratio of 5:1 (39,800-199,000 BTU/h), with a higher output temperature tolerance (±10° F.). The tankless water heater system comprises an integrated variable speed pump that operates to recirculate water between a storage tank in the hybrid water heater system and the tankless water heater, as well as regulate the output temperature.

Additionally, the lower turndown ratio leads to higher flu gas temperature. As such, a category 1 vent can be used with the tankless water heater as opposed to a category 3 vent as used by traditional tankless water heaters.

FIG. 1 shows an implementation of a water heater system 100. In some implementations, the water heater system 100 includes a heater housing 112. A variable speed pump 102, a heat exchanger 104, an output temperature sensor 106, and a controller 108 are disposed inside the heater housing 112. The heater housing 112 can be formed from a plastic, metal, wood, or ceramic material, and has mounting holes that allow the heater housing 112 to be mounted to a water heater stand, a wall, a storage tank, or any other surface capable of supporting a water heater system. In some implementations the water heater housing 112 is formed without mounting holes.

The variable speed pump 102 is a fluid pump that can be adjusted to pump fluid within a system at various flow rates. In some implementations, the variable speed pump 102 is configured to pump water from a cold water inlet 101*a* to a hot water outlet 101*b*. In some implementations, the variable speed pump 102 pumps water through a plumbing network. The variable speed pump 102 is electrically powered and controlled. In some implementations, the variable speed pump 102 can pump water at a rate of 0.5-6 gallons per minute, for example. The variable speed pump 102 can be a Grundfos UPML 25-104 water pump for example. Other flow rates and variable speed pumps may be used according to the teachings of this disclosure. The variable speed pump 102 has an inlet 102*a* and an outlet 102*b*, which are configured to be fluidically connected to other elements in a plumbing system, such as a pipe, a heat exchanger, a tank, or any other element found in a plumbing system.

The heat exchanger 104, having an inlet 104*a* and an outlet 104*b*. The inlet 104*a* of the heat exchanger 104 is fluidically connected to the cold water inlet 101*a*. In some implementations, the heat exchanger outlet 104*b* is fluidically connected to the variable speed pump 102 inlet 102*a*. Hot water from the heat exchanger 104 flows into the variable speed pump 102 which pushes the water out of the hot water outlet 101*b* through a plumbing network, a pipe, or to a storage tank, for example. The heat exchanger 104 includes a heat engine for heating water flowing from the heat exchanger inlet 104*a* to the heat exchanger outlet 104*b*. In some implementations, the heat exchanger includes a plurality of heat engines. In some implementations, heat engines utilize a natural gas burner, a propane burner, or electric heating elements to produce heat.

In some implementations, the heat engine(s) in the heat exchanger 104 operate at least at 39,800 BTU/h. Water from the inlet 104*a* that comes into the heat exchanger 104 passes through the heat exchanger 104 and is heated by heat engine(s) (e.g., electric heating elements or gas burners) within the heat exchanger 104. With such systems, the heat exchanger 104 is heated by a large current flow (or Gas/BTU input) which is regulated by an electronic control system. In some implementations the heat exchanger 104 can use a low turndown ratio BTU/h input range of 5:1, such as 39,800-199,000 BTU/h.

While some amount of volume or storage of water may be present in the water heater system 100, the size of such storage may be limited to about one gallon of water or less. Additionally, the water heater system 100 typically does not maintain the temperature of water within the water heater system 100 when not in use. Accordingly, the water heater system 100 may be referred to as a tankless water heater system 100. The tankless water heater system 100 may have an input of less than 200,000 BTU/hr. In some implementations, the tankless water heater system may have an input of at least 39,800 BTU/hr.

The output temperature sensor 106 is disposed downstream of the heat exchanger outlet 104*b*. The output temperature sensor 106 is an electronic temperature sensor that is disposed in line with fluid flow of water from the heat exchanger 104 outlet 104*b*. Although FIG. 1 shows the output temperature sensor 106 disposed downstream of the outlet 102*b* of the variable speed pump 102*b*, the output temperature sensor 106 can be disposed between the heat exchanger 104 outlet 104*b* and the water pump 102 inlet 102*a*. The output temperature sensor 106 can also be disposed inside a body of the heat exchanger 104, at a point downstream of a heating element, or in any other location where a heat exchanger outlet temperature can be measured.

The controller 108 is configured to receive a first temperature reading from the output temperature sensor 106. Additionally, the controller 108 is configured to receive a second temperature reading from a recovery temperature sensor 109. The first temperature reading received by the controller 108 is a measurement of the temperature of the water downstream of the heat exchanger 104. The second temperature reading received by the controller 108 is a measurement of the temperature of the water received at the cold water inlet 101*a*. The controller 108 is configured to control operation of the water heater system 100 based on the first and second temperature. For example, the controller 108 may control operation of the variable speed pump 102 and the heat exchanger 104, described above.

The controller 108 is configured to control the activation, deactivation, and flow rate of the variable speed pump 102. The controller 108 is configured to adjust an output flow rate of the variable speed pump 102 in response to the first and second temperature readings. The controller 108 compares the differential between the first temperature and the second temperature readings and is configured to send signals to variable speed pump 102 to activate, deactivate, increase flow rate, or decrease flow rate in response to a difference between the first temperature and second temperature.

In some implementations, the water heater system 100 has a fixed bypass 110 having a first end 110*a* that is fluidically connected to the heat exchanger 104 inlet 104*a* and a second end 110*b* that is fluidically connected to the heat exchanger 104 outlet 104*b* and the variable speed pump 102 inlet 102*a*. The bypass 110 has a fixed mechanical structure.

When the variable speed pump 102 and the heat exchanger 104 are powered off, the pressure between the cold water inlet 101*a* and the heat exchanger 104 inlet 104*a* is about the same as the pressure between the bypass inlet 110*a* and the bypass outlet 110*b*. Therefore, no water flows through the fixed bypass 110 when the variable speed pump 102 is off. When the variable speed pump 102 is on, water flows across the bypass outlet 110*b* causing a venturi effect to draw a fixed amount of cold water through the bypass 110. As such, water from the cold water inlet 101*a* flows from the bypass 110 inlet 110*a* to the bypass outlet 110*b*.

In some implementations, the controller 108 is configured to produce hot water from the hot water outlet 101*b* within a temperature threshold of a set point temperature. The set point temperature can be input to the controller 108 via a user interface (not shown) on the water heater system 100. In some implementations, the set point temperature can be received by the controller 108 remotely, such as from a mobile application. The set point temperature can also be changed dynamically by the logic of the controller 108. The controller 108 is configured to periodically compare the first temperature and/or the second temperature to the set point temperature and adjust operation of the water heater system 100 accordingly. For example, the controller 108 may adjust a flow rate of the variable speed pump 102 and/or an amount of heat introduced by the heat exchanger 104 (e.g., increase or decrease a BTU/h level of a gas burner in the heat exchanger 104).

For example, for a given amount of heat being added to the water by the heat exchanger 104, as the variable speed pump 102 increases the flow rate of water moving through the heat exchanger 104, the first temperature reading from the output temperature sensor 106 of the hot water output from the hot water outlet 101*b* will decrease. In other words, for a fixed amount of heat being added to the water, as the flow rate of water through the water heater system 100 increases, the temperature of output hot water decreases. Likewise, for the given amount of heat being added to the water by the heat exchanger 104, as the variable speed pump 102 decreases the flow rate of water moving through the heat exchanger 104, the first temperature reading from the output temperature sensor 106 of the hot water output from the hot water outlet 101*b* will increase. In other words, for a fixed amount of heat being added to the water, as the flow rate of water through the water heater system 100 decreases, the temperature of output hot water increases. Therefore, for a given amount of heat added to the water by the heat exchanger, there is a reciprocal relationship between the flow rate of the water and the temperature of the water.

In another example, for a given flow rate of water pumped by the variable speed pump 102, as the heat exchanger 104 increases the amount of heat being added to the water by the heat exchanger 104, the first temperature reading from the output temperature sensor 106 of the hot water output from the hot water outlet 101*b* will increase. Likewise, for a given flow rate of water pumped by the variable speed pump 102, as the heat exchanger 104 decreases the amount of heat being added to the water by the heat exchanger 104, the first temperature reading from the output temperature sensor 106 of the hot water output from the hot water outlet 101*b* will decrease. In other words, for a given flow rate of water, there is a direct relationship between the amount of heat added to the water and the temperature of the water.

While the above examples are provided by fixing one variable (e.g., one of an amount of heat added to the water or a flow rate of the water) and changing the other variable (e.g., the other of an amount of heat added to the water or a flow rate of the water), it is contemplated that the controller 108 may control both variables (e.g., the amount of heat added to the water and a flow rate of the water) at the same time to produce hot water within the threshold temperature of the set point temperature. In some implementations, the temperature threshold is plus or minus ten degrees from the set point temperature, greater than three degrees from the set point temperature, or greater than five degrees from the set point temperature. In some implementations, the set point temperature is greater than or equal to 120 degrees.

In some implementations, the heat exchanger 104 activates when fluid flows through it at or above an activation flow rate, and the heat exchanger 104 deactivates when water flows through it at a flow rate less than the activation flow rate. In some implementations, the heat exchanger 104 activates when the variable speed pump 102 is on and deactivates when the variable speed pump 102 is off.

The variable speed pump 102 may be turned on in response to a recovery event. When used with a storage tank, the recovery event may initiate an operation to refill the storage tank with hot water at the set point temperature. For example, the recovery event may be in response to expiration of a timer, in response to an external control signal (e.g., from a mobile application or external switch), in response to the recovery temperature sensor 109 falling below a minimum temperature, in response to a plumbing fixture in a plumbing network drawing hot water, or combinations thereof. Other recovery events are contemplated by this disclosure.

When the variable speed pump 102 is running the controller 108 can turn off the variable speed pump 102 in response to the reading from the recovery temperature sensor 109. In some implementations, the controller 108 turns off or slows the variable speed pump 102 upon a determination that the reading from the recovery temperature sensor 109 has reached a maximum temperature. The maximum temperature may be the set point temperature, a temperature value read from the output temperature sensor 106, or a temperature within an offset from the set point temperature or the output temperature sensor 106 (e.g., a temperature within 5-40° F.). Upon a determination that the maximum temperature has not been reached, the controller 108 continues to operate the heat exchanger 104 and variable speed pump 102, and the controller 108 continues to monitor temperature readings from the recovery tank temperature sensor 109 until the maximum temperature is reached.

Figure 2:
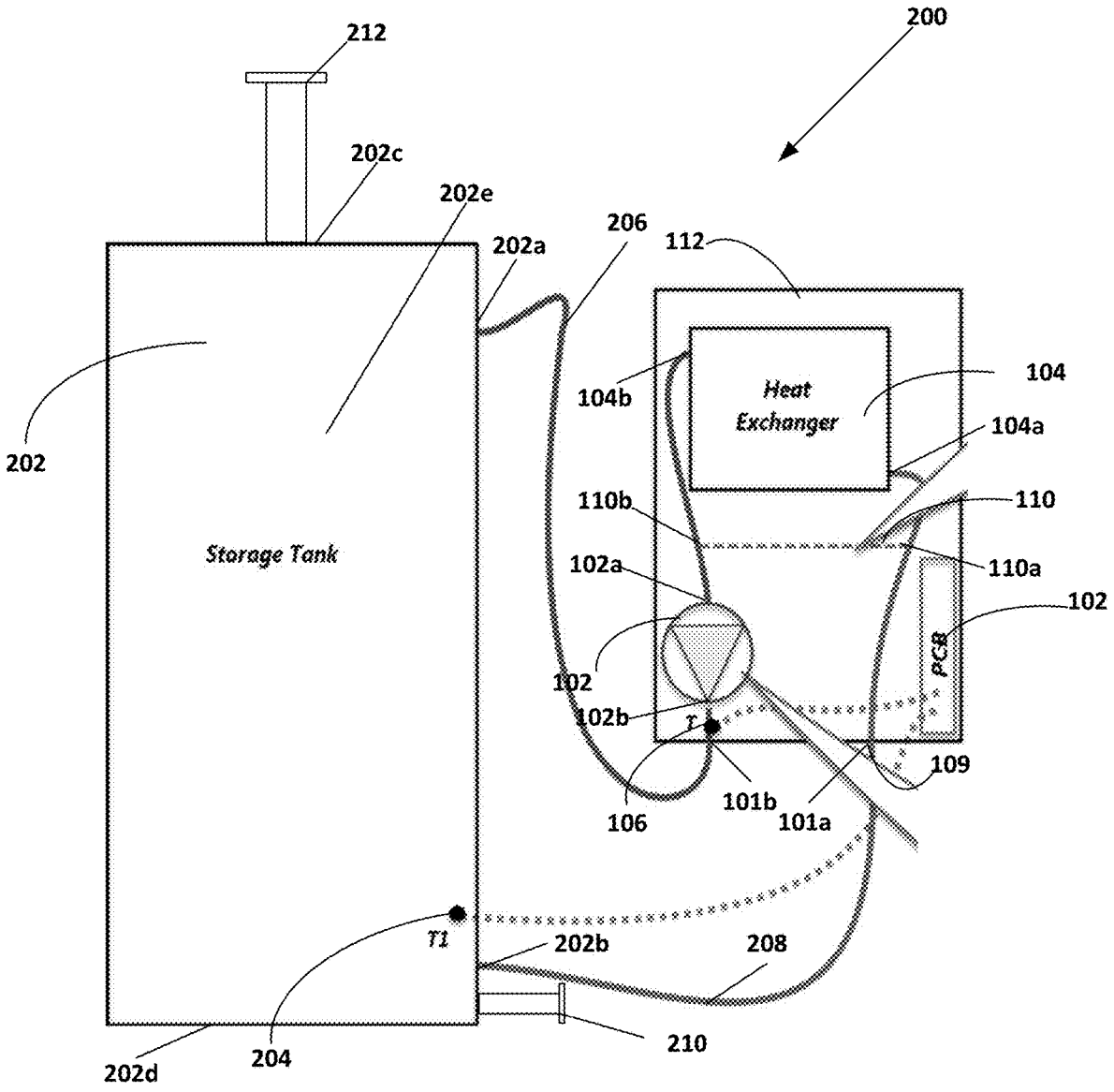
FIG. 2 shows a component view of a hot water storage system.

FIG. 2 shows an implementation of a hot water storage system 200. The hot water storage system 200 includes the water heater system 100, a storage tank 202 and a tank temperature sensor 204. The hot water heater system 100 is configured as discussed above with reference to FIG. 1 where like numbers represent like parts. The storage tank 202 has a recovery inlet 202*a*, a recovery outlet 202*b*, a top 202*c*, a bottom 202*d*, and a cylindrical wall 202*e*. The storage tank 202 also has a cold water supply inlet 210 and a hot water outlet 212. The cold water supply inlet 210 may receive cold water from a municipal water supply and/or a return line of a recirculation circuit of a plumbing system (not shown). The hot water outlet 212 may supply hot water from the storage tank 202 to the plumbing system.

The cylindrical wall 202*e* is disposed between the top 202*c* and the bottom 202*d* of the storage tank 202 and encloses a volume. The storage tank 202 can be configured to hold a volume of fluid. The storage tank 202 is configured to limit the rate that heat escapes the storage tank 202. For example, the cylindrical wall 202*e* may be surrounded by insulation, which prevents some heat from escaping the storage tank 202. An upper portion of the storage tank 202 is disposed closer to the top 202*c* of the storage tank 202, and a lower portion is disposed closer to the bottom of the storage tank 202. The upper portion and the lower portion are fluidically connected, where water in the upper portion can freely mix with water in the lower portion. The recovery inlet 202*a* is disposed on the cylindrical wall 202*e* of the storage tank 202 near the top 202*c* of the storage tank 202 in the upper portion of the storage tank 202. The recovery outlet 202*b* is disposed on the cylindrical wall 202*e* of the storage tank 202 near the bottom 202*d* of the storage tank 202 in the lower portion of the storage tank 202. In some implementations, the recovery inlet 202*a* is disposed on an upper portion of the storage tank 202, and the recovery outlet 202*b* is disposed on a lower portion of the storage tank 202.

The recovery inlet 202*a* receives hot water from the hot water outlet 101*b* of the water heater system 100 for storage in the storage tank 202. Although FIG. 2 shows the recovery inlet 202*a* coupled to a water pipe 206, the recovery inlet 202*a* can be coupled to a pipe, a valve, a heat engine outlet, or any other plumbing fixture that can supply hot water to the storage tank 202.

The recovery outlet 202*b* supplies cold water to the hot water inlet 101*a* of the water heater system 100. Although FIG. 2 shows the recovery outlet 202*b* coupled to a water pipe 208, the recovery outlet 202*b* can be coupled to pipe, a valve, a heat engine inlet, or any other plumbing fixture that can supply water from the water storage tank 202.

The tank temperature sensor 204 can be a temperature sensor, a thermistor, a thermocouple, or any other temperature sensor that can sense temperature in a plumbing network. For example, the tank temperature sensor 204 may be a ¾" MNPT, 10K Ohm thermistor. Other temperature sensors may be used according to the teachings of this disclosure. The tank temperature sensor 204 is configured to sense and transmit a signal indicative of the temperature of the water from the storage tank 202 to the controller 108.

The second temperature reading received by the controller 108, as described above, is a measurement of the temperature of water by the tank temperature sensor 204. The tank temperature sensor 204 is in electrical communication with the controller 108 where the tank temperature sensor 204 sends signals to the controller 108 indicating the second temperature. In the example shown in FIG. 2, the tank temperature sensor 204 is disposed at a location proximate to and above the recovery outlet 202*b*. Within the context of this disclosure, "above" is in a direction from the recovery outlet 202*b* to the recovery inlet 202*a*. In some implementations the tank temperature sensor 204 is disposed inside the storage tank 202 and reads the temperature of the water that flows out of the recovery outlet 202*b*. Although FIG. 2 shows the tank temperature sensor 204 disposed at a location inside the storage tank 202, the tank temperature sensor 204 can be disposed outside the recovery outlet 202*b*, a plumbing fixture coupled to the recovery outlet 202*b*, or at any location that allows the tank temperature sensor 204 to read the temperature about the lower portion of the storage tank 202. For example, the tank temperature sensor 204 may be disposed at a location on the water pipe 208 fluidically coupled between the recovery outlet 202*b* and the cold water inlet 101*a*.

In operation, the variable speed pump 102 circulates hot water between the water heater system 100 and the storage tank 202. Hot water supplied by the variable speed pump 102 is provided from the hot water 101*b* to the recovery inlet 202*a*. At the same time, cold water is drawn from the recovery outlet 202*b* and supplied to the heat exchanger 104 to be heated therein. As the variable speed pump 102 operates, the volume of hot water stored within the storage tank 202 increases until water of the maximum temperature is detected by the tank temperature sensor 204.

Water in the lower portion of the storage tank 202 will be cooler than the water in the upper portion of the storage tank 202, where water from the hot water outlet 101*b* is supplied to the storage tank 202. When the water at the lower portion of the tank 202 reaches a desired temperature (e.g., the maximum temperature is detected by the tank temperature sensor 204), the controller 108 will stop the variable speed pump 102 from pumping water.

The controller 108 is configured to control operation of the variable speed pump 102 to adjust an output flow rate in response to the first and second temperature readings. The controller 108 controls the activation, deactivation, and flow rate of the variable speed pump 102. The controller 108 compares the differential between the tank temperature sensor 204 and the output temperature sensor 106 and sends a signal to the variable speed pump 102 to activate, deactivate, increase flow rate, and decrease flow rate. In some implementations, a set point temperature is stored on the controller 108 periodically to compare the second temperature to the set point temperature. In some implementations, the controller 108 is configured to receive temperature readings from the output temperature sensor 106 and the tank temperature sensor 204, and to adjust the output flow rate. Accordingly, rather than using a flow control valve to adjust the flow rate of water through the water heater system, the controller 108 adjusts the speed of the variable speed pump to match the output temperature sensed by the output temperature sensor 106 to the set point temperature stored on the controller 108. Therefore, the variable speed pump 102 facilitates both circulation of water between the water heater system 100 and the storage tank 202 as well as control to ensure that the output temperature of water supplied by the water heater system 100 matches the set point temperature.

When the controller 108 determines that the water in the lower portion of the storage tank 202 has fallen below a set point temperature, the controller 108 sends a signal to turn on the variable speed pump 102. The controller 108 is configured to maintain the set point temperature within the temperature threshold. In some implementations, the set point temperature is greater than 120 degrees. The controller 108 increases and decreases the variable speed pump 102 flow rate and/or the amount of heat supplied by the heat exchanger 104 to maintain the first temperature within the temperature threshold of the set point temperature. For example, the variable speed pump 102 increases the flow rate to decrease the temperature or decrease the flow rate to increase the temperature of water supplied from the hot water outlet 101*b* to the recovery inlet 202*a*. In some implementations, the temperature threshold is plus or minus ten degrees of the set point temperature. The controller 108 is configured to control the heat exchanger 104 to output water at a desired temperature. In some implementations, the controller 108 instructs the system 100 to output water at the desired temperature and controls the amount of heat added to the water (e.g. BTU/h of heater) and flow rate of the water. When water is already flowing through the heat exchanger 104 the controller 108 can adjust the flow rate of the variable speed pump 102 to maintain the water temperature within a desired temperature range of the set point temperature. This can be done without completely stopping or starting the variable speed pump 102.

Figure 3:
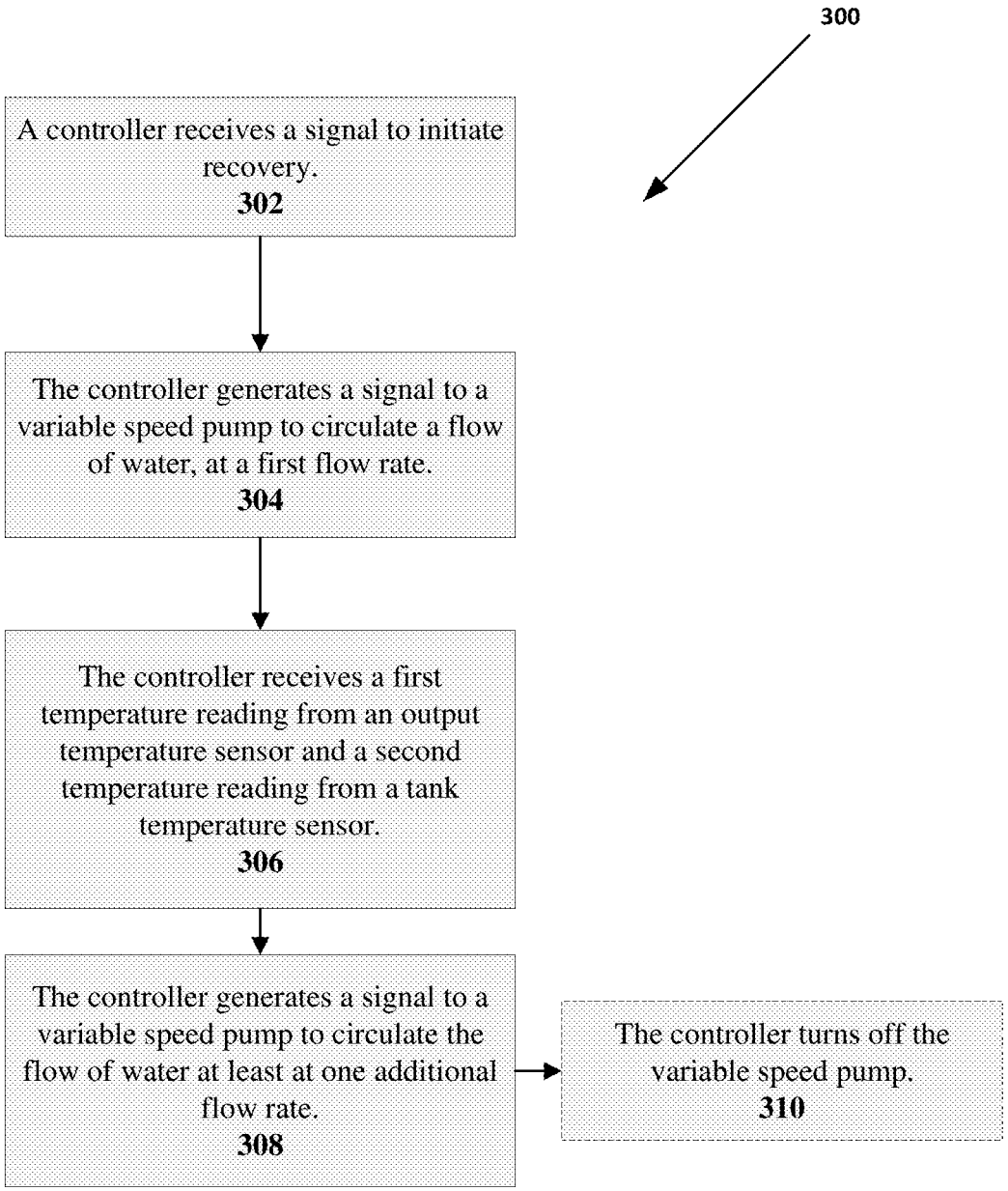
FIG. 3 is a flow chart of a method of operation for the hot water storage system.

FIG. 3 shows a flow-chart of a method 300 for heating water. At 302, the controller 108 receives a signal from a user to initiate recovery. The signal can be set to occur at a specific time, at a time interval, based on a temperature reading, or the signal can be activated manually at the time a user desires. At 304, the method includes generating a signal to the variable speed pump 102 to circulate a flow of water, at a first flow rate. In some implementations, the flow rate is a base-line flow rate predetermined by a user or preset in the controller 108.

At 306, the method includes receiving a first temperature reading from the output temperature sensor 106 and a second temperature reading from a tank temperature sensor 204. The first temperature reading can be received from the output temperature sensor 106 at a location downstream of the heat exchanger 104 as described above.

At 308, the method includes generating a signal to the variable speed pump 102 to circulate the flow of water at least at one additional flow rate. If the first temperature reading is too low, then the water circulates at a slower flow rate and/or higher BTU/h to increase the amount of heat added to the water from the heat exchanger 104. If the first temperature reading is too high, then the water circulates at a higher flow rate and/or lower BTU/h to decrease the amount of heat added to the water from the heat exchanger 104. The heated water circulates between the hot water outlet 101*b* and the recovery inlet 202*a*. The water also circulates between the recovery outlet 202*b*, and the cold water inlet 101*a*. This allows water that cooled in the lower portion of the storage tank 202 to be reheated in the heat exchanger 104.

In some implementations, the method 300 also includes the controller 108 turning off the variable speed pump 102, at 310. For example, upon the controller 108 determining that the second temperature reading from the tank temperature sensor 204 has reached the maximum temperature, the controller 108 turns off the variable speed pump 102. For example, the controller 108 may stop supplying power to the variable speed pump 102 or supply an instruction for the variable speed pump 102 to turn off. The maximum temperature may be the set point temperature, a temperature value read from the output temperature sensor 106, or a temperature within an offset from the set point temperature or a value read from the output temperature sensor 106 (e.g., a temperature within 5-40° F.).

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A water heater system comprising:

a variable speed pump having a pump inlet and a pump outlet, wherein the variable speed pump is configured to be adjustable to pump fluid at a plurality of flow rates;

a heat exchanger, having a heat exchanger inlet and a heat exchanger outlet, wherein the heat exchanger outlet is fluidically connected to the pump inlet;

an output temperature sensor disposed downstream of the heat exchanger outlet and configured to measure a temperature of water output from the heat exchanger outlet; and a controller configured to:

receive a first temperature reading from the output temperature sensor, control both an amount of heat added via the heat exchanger and operation of the variable speed pump to adjust an output flow rate to one of the plurality of flow rates in response to the first temperature reading, adjust an amount of heat introduced by the heat exchanger within a turndown ratio less than 13:1, and maintain the temperature of water output from the heat exchanger within a threshold of a set point temperature, wherein the threshold is greater than five degrees Fahrenheit.

2. The water heater system of claim 1, wherein the controller is further configured to receive a second temperature reading from a recovery temperature sensor, wherein the controller is configured to turn off the variable speed pump upon a determination that the second temperature reading has reached a maximum temperature.

3. The water heater system of claim 1, wherein the set point temperature is greater than 120° F. and the threshold is greater than 3° F.

4. The water heater system of claim 1, further comprising a fixed bypass having a first end that is fluidically connected to the heat exchanger inlet and a second end that is fluidically connected to the heat exchanger outlet and the pump inlet.

5. The water heater system of claim 1, further comprising a heater housing, wherein the variable speed pump, the heat exchanger, the output temperature sensor, and the controller are disposed inside the heater housing.

6. The water heater system of claim 1, wherein a heater in the heat exchanger operates at least at 39,800 BTU/h.

7. A hot water storage system comprising:

a storage tank including a tank inlet and a tank outlet;

a tank temperature sensor positioned adjacent to the tank outlet and configured to provide tank temperature information; and a tankless water heater system comprising:

a heat exchanger including a heat exchanger inlet fluidically coupled to the tank outlet and a heat exchanger outlet fluidically coupled to the tank inlet;

a variable speed pump configured to provide an adjustable output flow rate of water through the heat exchanger;

an output temperature sensor disposed downstream of the heat exchanger outlet and configured to provide heat exchanger output temperature information; and a controller configured to:

control an amount of heat added via the heat exchanger within a turndown ratio less than 13:1, control the output flow rate of the variable speed pump based on the heat exchanger output temperature information, turn off the variable speed pump when the tank temperature information is equal to or greater than a maximum temperature, and control the amount of heat added and the variable speed pump to maintain the heat exchanger output temperature information within a threshold of a set point temperature, wherein the threshold is greater than or equal to five degrees Fahrenheit and the set point temperature is greater than or equal to 120 degrees Fahrenheit and less than or equal to 183 degrees Fahrenheit.

8. The system of claim 7, wherein the tank inlet is disposed on an upper portion of the storage tank, and the tank outlet is disposed on a lower portion of the storage tank.

9. The system of claim 7, wherein the threshold is plus or minus ten degrees Fahrenheit of the set point temperature.

10. The system of claim 7, wherein the controller is further configured to decrease the output flow rate when the heat exchanger output temperature information is less than the set point temperature minus the threshold.

11. The system of claim 7, wherein the tankless water heater system further includes a fixed bypass having a bypass inlet that is fluidically connected to the heat exchanger inlet and a bypass outlet that is fluidically connected to the heat exchanger outlet and the variable speed pump.

12. The system of claim 7, wherein the tankless water heater system further includes a heater housing, and wherein the variable speed pump, the heat exchanger, the output temperature sensor, and the controller are disposed inside the heater housing.

13. A method of heating water comprising:

receiving a signal to initiate circulation;

generating a signal to a variable speed pump to circulate a flow of water at a first flow rate from an outlet of a heat exchanger to an inlet of a storage tank and from an outlet of the storage tank to an inlet of the heat exchanger, wherein the variable speed pump is configured to be adjustable to pump fluid at a plurality of flow rates;

controlling an amount of heat added by the heat exchanger to the flow of water to be within a turndown ratio less than 13:1;

receiving a first temperature reading from an output temperature sensor downstream of the heat exchanger and configured to measure a temperature of water output from the outlet of the heat exchanger; and generating a signal to the variable speed pump to circulate the flow of water at least at one additional flow rate of the plurality of flow rates in response to the first temperature reading, wherein the temperature of water output from the outlet of the heat exchanger is maintained within a threshold of a set point temperature, and wherein the threshold is greater than five degrees Fahrenheit.

14. The method of claim 13, wherein the threshold is plus or minus ten degrees Fahrenheit of the set point temperature.

15. The method of claim 13, wherein the set point temperature is greater than 120 degrees Fahrenheit.

16. The method of claim 13, further comprising sending a signal to operate a heater in the heat exchanger at least at 39,800 BTU/h.

17. The method of claim 13, further comprising:

receiving a second temperature reading from a tank temperature sensor positioned adjacent to the outlet of the storage tank; and turning off the variable speed pump upon the second temperature reading reaching a maximum temperature.

* * * * *